United States Patent [19]

Rader

[11] 3,938,585

[45] Feb. 17, 1976

[54] GRID EJECTION MECHANISM FOR A BATTERY GRID CASTING MACHINE

[75] Inventor: Robert R. Rader, Port Huron, Mich.

[73] Assignee: Wirtz Manufacturing Company, Inc., Port Huron, Mich.

[22] Filed: Jan. 4, 1974

[21] Appl. No.: 430,887

[52] U.S. Cl. ..... 164/347; 425/444

[51] Int. Cl.[2] ..... B22D 17/22; B22D 29/00

[58] Field of Search ..... 164/347, 404; 425/444

[56] References Cited

UNITED STATES PATENTS 1,880,380 10/1932 Frantz ..... 164/347 X

FOREIGN PATENTS OR APPLICATIONS 1,171,569 11/1962 Germany ..... 164/347

*Primary Examiner*—Robert D. Baldwin

*Attorney, Agent, or Firm*—Barnes, Kisselle, Raisch & Choate

[57] ABSTRACT

A mechanism for opening and closing the mold of a battery grid casting machine which includes a reciprocable slide to which the movable mold half is directly connected for movement in unison therewith. A cam mounted on and movable with the slide is arranged to engage a cam follower within the first three-quarters of the slide stroke. The cam follower is operatively connected with knock-out pins on the stationary mold half to eject the cast grid during the opening stroke of the movable mold half.

20 Claims, 5 Drawing Figures

GRID EJECTION MECHANISM FOR A BATTERY GRID CASTING MACHINE

This invention relates to a battery grid casting machine and, more particularly, to a mechanism for ejecting the cast battery grid from the mold.

From the standpoint of economy it is desirable to operate a grid casting machine on the shortest time cycle which is practical. This time cycle may be generally divided into three successive intervals; namely, filling the mold, solidication of the grid and mold opening and closing. The grid is ejected from the mold during the mold opening and closing interval. Accordingly, the quicker the grid can be ejected from the mold and out of the path of travel of the movable mold half, the shorter the time interval required for opening and closing the mold.

Another economic factor involved in the design of a battery grid casting machine resides in the simplicity of the machine and its durability. Durability is important from the standpoint of the frequency of repair and servicing.

The present invention has for its object the provision of a grid ejection mechanism for a grid casting machine which is of economical design from the standpoint of both a short cycle time and simplicity and durability of the machine itself.

More specifically, in the grid ejection mechanism according to the present invention a cam is mounted on a reciprocating slide employed for opening and closing the mold. The cam moves bodily with the slide. A cam follower is mounted at a fixed location on the machine so that it is engaged by the cam before the slide has traversed more than three-quarters of its stroke in the mold opening direction. The cam follower is momentarily operated by the cam to reciprocate a plurality of grid knock-out pins on the stationary half of the mold so that the grid is ejected from the stationary mold half during the first three-quarters of the travel of the movable mold section away from the stationary mold section. With this arrangement the timing of the grid ejection mechanism is such that the ejected grid will not contact the moving half of the mold and ample time is afforded for the grid to drop down out of the path of the moving mold half on the return stroke thereof. This enables opening and closing of the mold in a minimum time interval without interference with the ejected grid. It is important to avoid contact between the ejected grid and the moving mold section to avoid distortion of the fragile grid and also to avoid accidental contact between the ejected grid and the fragile corked surface of the mold.

Figure 1:
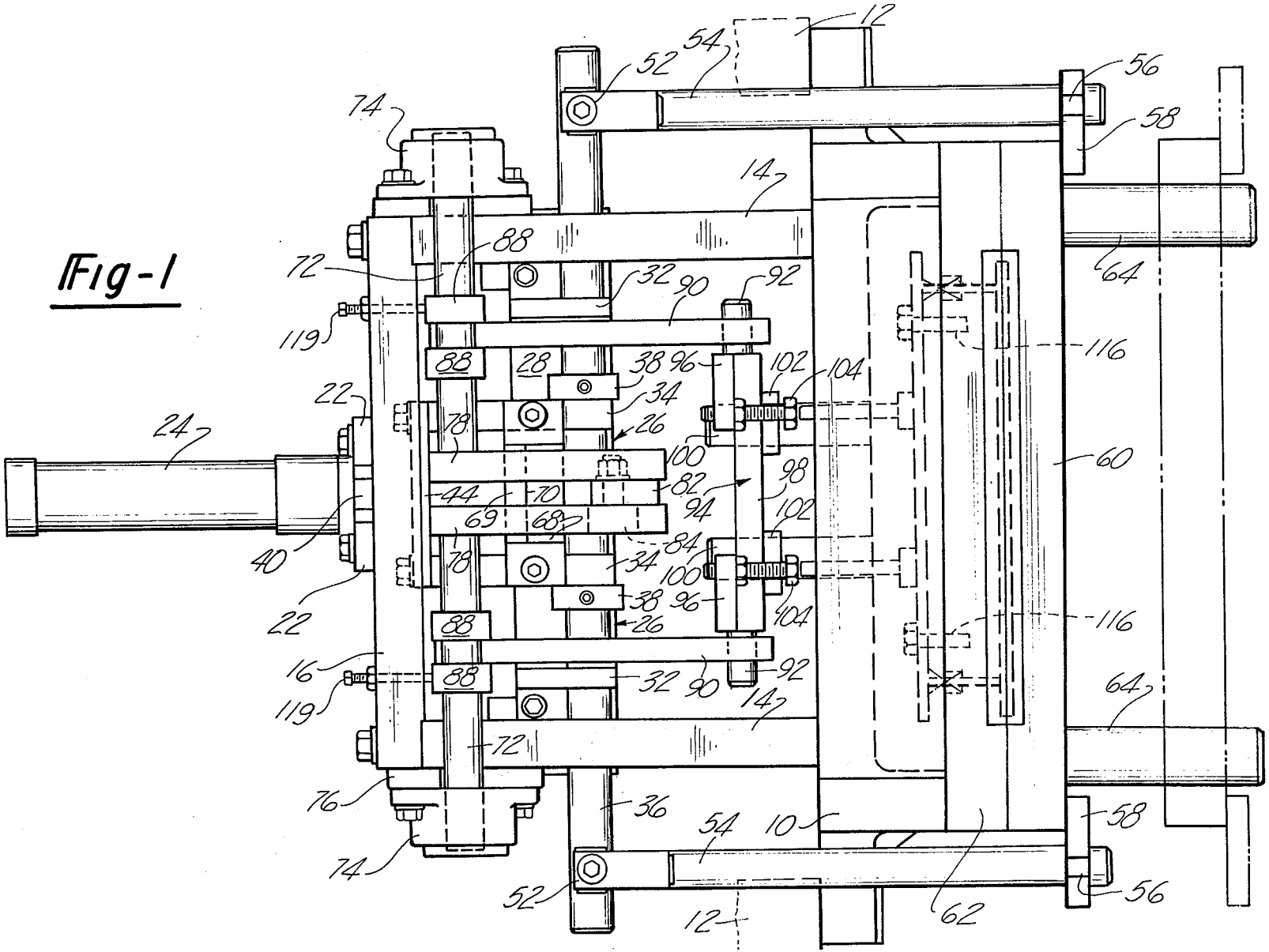
FIG. 1 is a plan of a mold opening mechanism for a battery grid casting machine employing the grid ejecting mechanism of the present invention.
Figure 2:
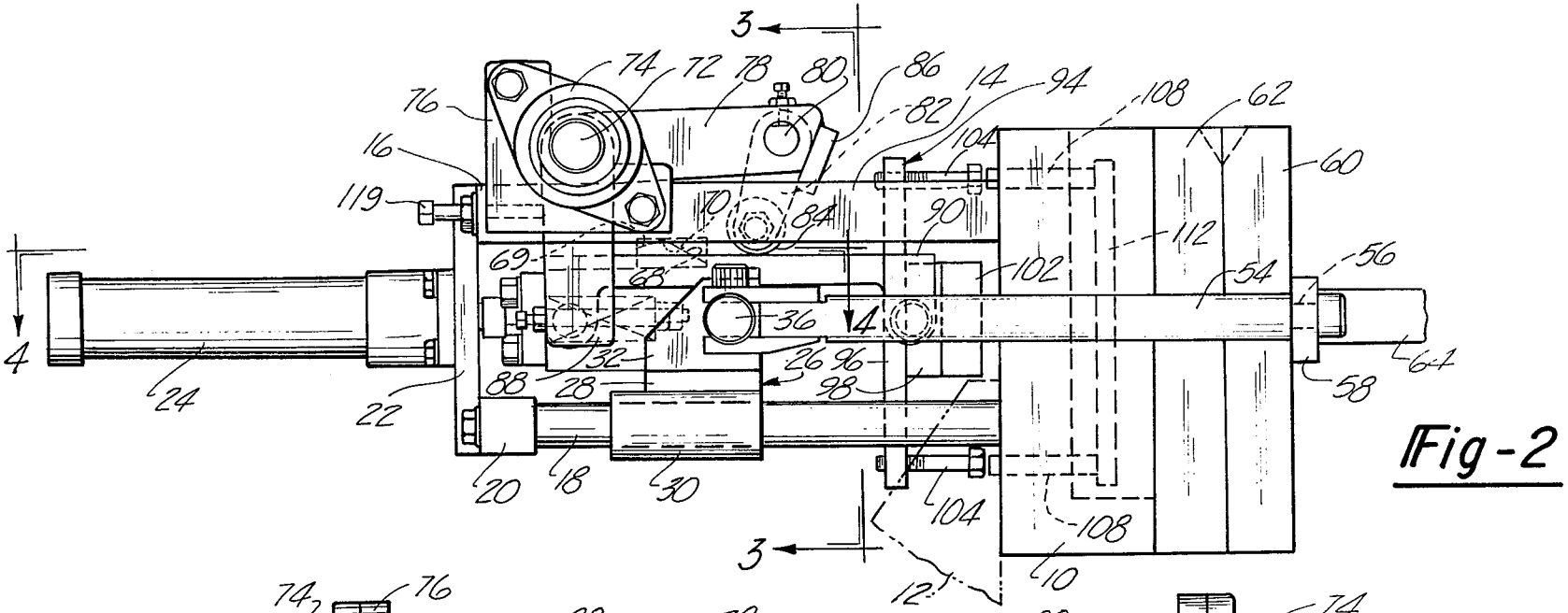
FIG. 2 is a side elevational view of the mechanism illustrated in FIG. 1.

Referring first to FIGS. 1 and 2, there is illustrated at 10 a mold back or support which is fixedly mounted on the frame of a battery grid casting machine by means of brackets 12. The entire mold opening and closing mechanism is supported by mold back 10. A pair of upper support bars 14 are fixedly mounted on the rear face of mold back 10 and project rearwardly therefrom. The rear ends of support bars 14 are interconnected by a transverse bar 16. The supporting structure also includes a pair of lower support bars 18 of circular cross section which are fixedly attached to the rear face of mold back 10. At their rear ends support bars 18 are interconnected by a transverse bar 20. Adjacent the central portion thereof bars 16 and 20 are interconnected by a pair of spaced vertically extending tie bars 22 on which an air cylinder 24 is fixedly supported.

Figure 3:
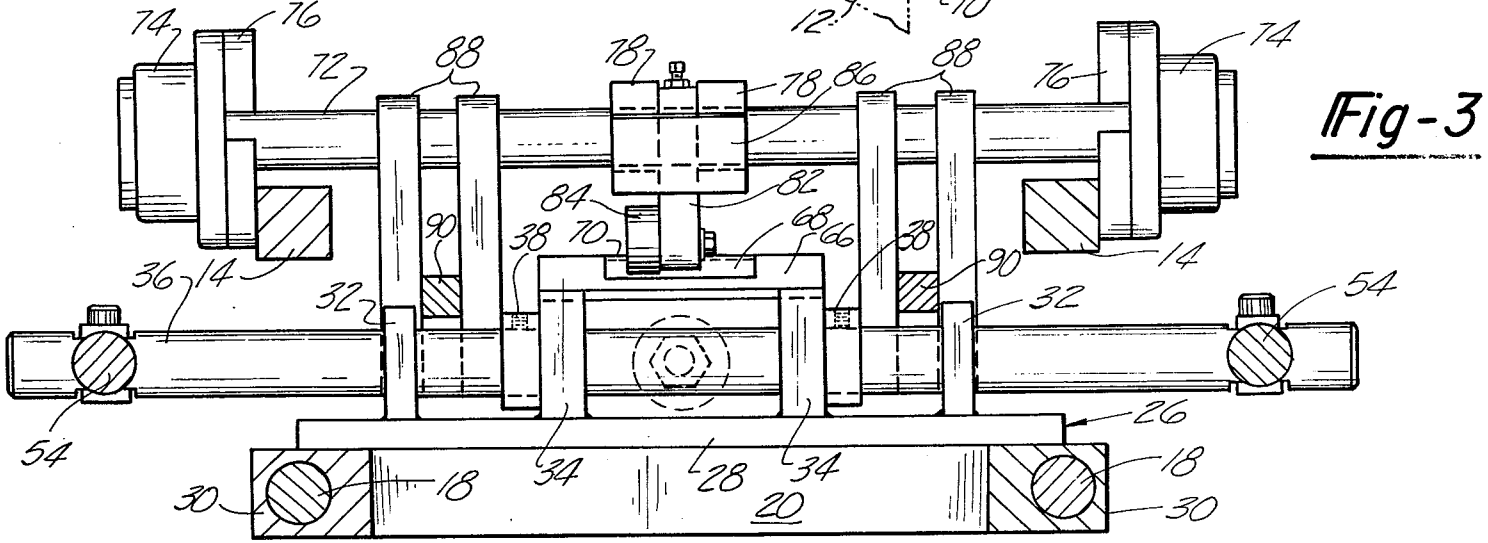
FIG. 3 is a sectional view along the line 3—3 in FIG. 2.

Lower support bars 18 serve as guide bars for a slide, generally designated 26. Slide 26 comprises a base plate 28 which transversely spans support bars 18 and has bushings or bearings 30 attached to the underside thereof at its outer ends which are slideably arranged on bars 18. On its top face base plate 28 fixedly supports a pair of outboard brackets 32 and a pair of spaced inboard brackets 34 (FIG. 3). Brackets 32, 34 are formed with transversely aligned openings through which a cross rod 36 extends. Cross rod 36 is locked on slide 26 by a pair of bushings 38 provided with set screws which enable the bushings to be fixedly clamped on the cross rod.

Figure 4:
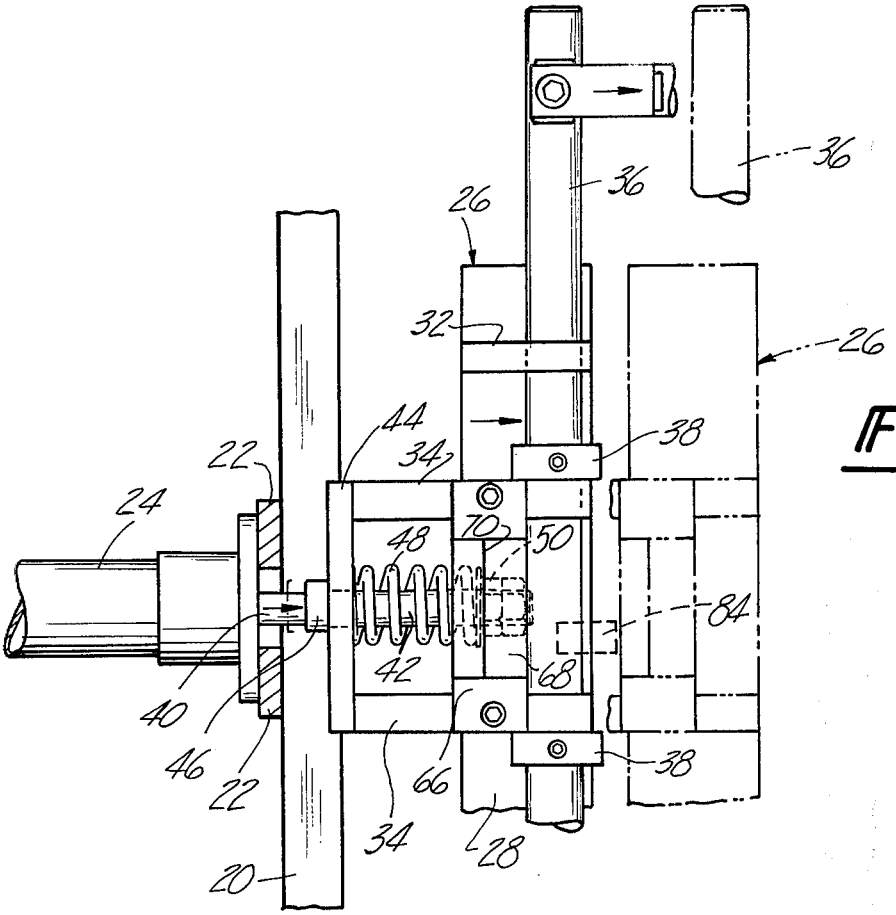
FIG. 4 is a fragmentary sectional view along the line 4—4 in FIG. 2.

Referring now more particularly to FIG. 4, cylinder 24 has a piston rod 40 extending horizontally between tie bars 22. To the outer end of rod 40 there is attached an extension 42 extending through a cross bar 44 which spans and is connected to the rear ends of upstanding brackets 34. The rear end of extension 42 is formed with an enlarged head 46 which bears against the rear face of cross bar 44. A coil spring 48 encircling extension 42 is retained in a compressed state against the front face of cross bar 44 by a pair of lock nuts 50 on the forward end of piston rod extension 42. By means of this arrangement piston rod 40 is connected with slide 26.

Figure 5:
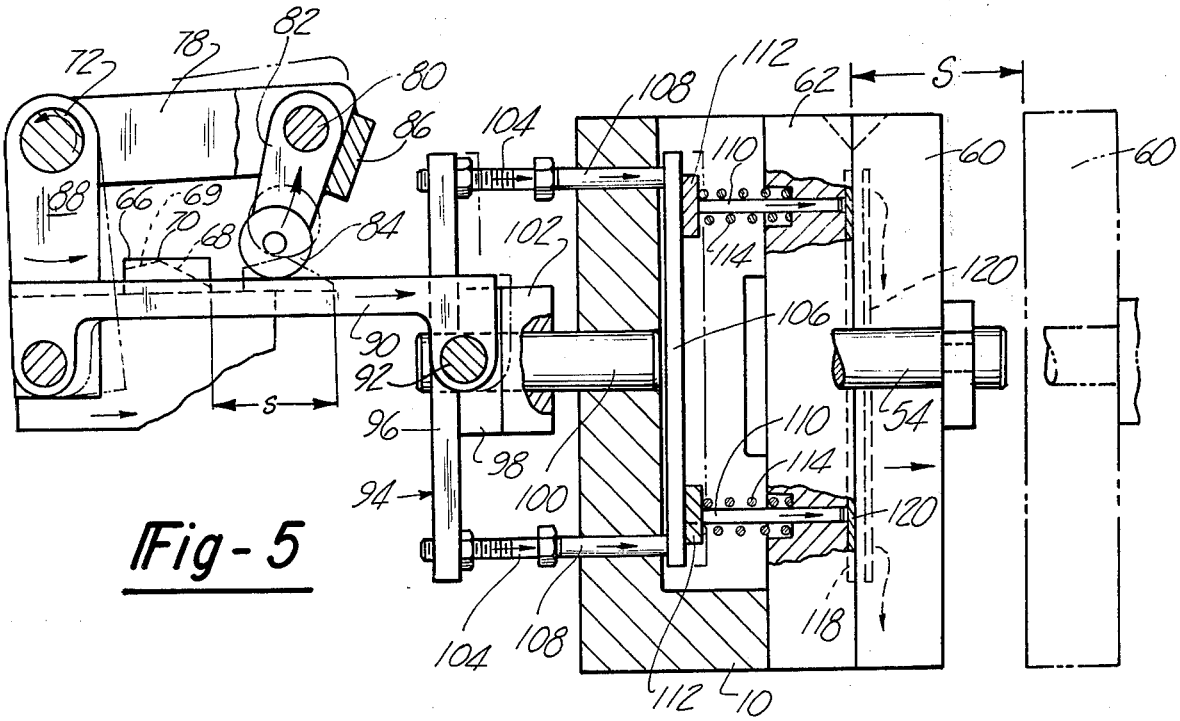
FIG. 5 is a fragmentary vertical sectional view illustrating the grid ejection mechanism.

The opposite ends of cross rod 36 are connected as at 52 with the rear ends of a pair of drawbars 54. Drawbars 54 extend forwardly beyond mold back 10 at each side thereof and are interconnected, as at 56, with lugs 58 attached to the opposite sides of a movable mold half 60. The stationary mold half 62 is fixedly mounted on mold back 10 and supports a pair of pilot pins 64 on which the movable mold half 60 is slideably supported. When cylinder 24 is actuated to open the mold, slide 26 is shifted forwardly on bars 18 and cross rod 36, acting through drawbars 54, displaces the movable mold half 60 from the closed position shown in solid lines in FIG. 1 to the broken line position. The distance through which the movable mold half 60 is displaced is designated S in FIG. 5, which is also the distance through which slide 26 is displaced on bars 18.

A cam plate 66 extends across and is mounted on the upper ends of brackets 34. Cam plate 66 has a cam surface 68 thereon which slopes upwardly and rearwardly to a high point 70 and then downwardly and rearwardly as at 69. Since cam plate 66 is mounted on the slide 26 it reciprocates bodily with the slide. The operation of the grid ejecting mechanism is controlled by cam surfaces 68, 69. This mechanism includes a cross rod 72 journalled at each end in bearings 74 which are mounted on brackets 76. Brackets 76 are in turn fixedly mounted on support bars 14 and the outer ends of the upper cross bar 16. At the central portion thereof cross rod 72 has a pair of spaced arms 78 fixedly mounted thereon and extending generally horizontally forwardly therefrom. Between the distal ends of arms 78 there is pivotally supported, as at 80, a depending lever 82. A cam follower roller 84 is journalled at the lower end of lever 82. Cam follower 84 is disposed in the path of travel of cam surface 68. Lever 82 is free to swing about its pivot axis 80 in a clockwise direction as viewed in FIGS. 2 and 5. However, a stop plate 86 limits the pivotal movement of lever 82 in a counter-clockwise direction to the position shown in solid lines in FIG. 5. Two additional pairs of spaced arms 88 are also fixedly mounted on cross rod 72 outboard of the central arms 78. These arms depend vertically downwardly. Between the lower ends of each pair of arms 88 there is pivotally supported the rear end of a generally horizontally extending link 90. The forward ends of links 90 are pivotally connected to pins 92 projecting laterally outwardly from an auxiliary slide 94.

Slide 94 comprises a pair of spaced apart upright bars 96 spanned and integrally connected by a horizontally extending cross bar 98. Slide 94 is guided for movement horizontally toward and away from the rear face of mold back 10 by a pair of pilot pins 100 press fitted into mold back 10 and received within bushings 102 mounted on the cross bar 98. Adjustable headed screws 104 are threaded into the upper and lower ends of upright bars 96 and project horizontally forwardly toward the rear face of mold back 10. Within mold back 10 there is arranged a pair of vertically extending, laterally spaced knock-out bars 106 which are slideably supported by guide pins 108. Guide pins 108 are axially aligned with the heads of screws 104. Within the stationary mold half 62 there are slideably arranged pairs of upper and lower knockout pins 110. The rear ends of these pins are interconnected by cross bars 112 which are adapted to be abutted by the vertical knock-out bars 106. Pins 110 are biased to a retracted position by coil springs 114, the extent of retraction being limited by adjusting screws 116 (FIG. 1). In the retracted position knock-out pins 110 have their forward ends flush with the rear face of the cavity 118 in stationary mold half 62.

In operation cylinder 24 is cyclically actuated to open and close the mold. When actuated the piston rod 40 is displaced axially forward to shift slide 26 forwardly and thereby cause the movable mold half 60 to be displaced from the solid to the broken line position illustrated in FIG. 1. Cam follower 84 is located relative to the retracted position of slide 26 so that when the mold has travelled not more than three-quarters of its stroke in the opening direction the cam follower is engaged by cam surface 68 of plate 66. This distance is designated *s* in FIG. 5. The inclination of lever 82 is such that when roller 84 engages the upwardly and rearwardly inclined cam surface 68 the resultant force tends to pivot lever 82 in a counter-clockwise direction. However, since pivotal movement of lever 82 in a counter-clockwise direction is prevented by stop bar 86, as roller 84 rides up this inclined surface arms 78 are pivoted upwardly about the axis of cross rod 72. When the roller reaches the high point 70 of the cam, arms 78 are displaced to the position shown in broken lines in FIG. 5. Since arms 78 and arms 88 are angularly fixed relative to each other it follows that as arms 78 swing upwardly links 90 are displaced forwardly producing a corresponding displacement of slide 94. Thus, pins 108 are abutted by the heads of screws 104 and cause the knockout pins 110 to be projected forwardly and thereby eject the grid 120 from the stationary mold half 62.

It will be observed that in the arrangement shown the extent to which slide 94 is displaced forwardly is only a small fraction of the stroke of the movable mold half 60. For example, if the stroke S is about three inches, then the distance *s* is not more than about 2¼ inches, preferably not more than about 2 inches, and the stroke of the knockout pins 110 is not more than about one-quarter inch. As cam follower 84 rides over the downwardly and rearwardly sloping cam surface 69 the resultant force is such as to pivot lever 82 in a clockwise direction. When this occurs arms 78, under the biasing force of springs 114, immediately swing downwardly until arms 88 engage stop screws 119 to enable pins 110 to retract. Thus, a slight and sharp retraction stroke is imparted to pins 110 immediately upon reaching their fully projected position. This enhances the quick and clean separation between the grid and the ends of knock-out pins 110.

By actuating the knock-out pins within the first three-quarters (and preferably between one-half and two-thirds) of the stroke of the movable mold half it will be appreciated that the grid is ejected from the stationary mold half long before the movable mold half reaches the fully open position. Experience has shown that when the knock-out pins are actuated in this fashion the grid is ejected from the mold without hitting the movable mold half; and, before the movable mold half returns substantially towards its closed position, the grid has dropped sufficiently downwardly so that its upper edge clears and is disposed below the lower edge of the moving mold half. Thus, this arrangement enables the mold to be opened and closed within a very short interval of time. In addition, the ejecting mechanism is of simple and durable construction so that the frequency of repair and servicing is reduced to a minimum.

I claim:

1. In a battery grid casting machine which includes a stationary mold member and a movable mold member movable through a predetermined distance toward and away from the stationary mold member to open and close the mold, the combination comprising, a reciprocating mechanism connected to the movable mold member and movable through said predetermined distance to open and close the mold, said stationary mold member having a plurality of reciprocable grid knock-out pins thereon movable from a retracted to a projected position for ejecting a cast grid from the stationary mold member, means for actuating said pins and means operatively interconnecting said reciprocating mechanism with said actuating means and operable during the first half to three-quarters of the mold opening stroke to shift said pins to the fully projected position within said fraction of the mold opening stroke and thereby eject the grid.

2. The combination set forth in claim 1 wherein said pin actuating means includes a shaft rockable about a fixed axis to actuate said pins, an arm fixed on said shaft, a cam follower supported by said arm and a cam mounted to reciprocate with said reciprocating mechanism, said cam follower lying in the path of travel of the cam and being engaged by the cam to rock said shaft and thereby actuate said pins.

3. The combination set forth in claim 2 wherein said reciprocating mechanism is reciprocable in a generally linear path.

4. The combination set forth in claim 3 wherein the stroke of said knock-out pins in moving from the retracted to the projected position is substantially less than one-quarter of said predetermined distance.

5. The combination set forth in claim 1 including means for operatively disconnecting said pin actuating means from said reciprocating mechanism when the pins reach their fully projected position and means biasing said pins to their retracted position whereby said pins are retracted by said biasing means before the movable mold member reaches the end of its stroke in the opening direction.

6. In a battery grid casting machine which includes a stationary mold member and a movable mold member movable through a predetermined distance toward and away from the stationary mold member to open and close the mold, the combination comprising, a rectilinearly movable slide, means for moving said slide through a predetermined stroke from a retracted to an extended position, said movable mold member being connected with said slide for movement in unison therewith, said movable mold being shifted from the closed to the open position when the slide moves from the retracted to the extended position, a cam bodily movable with said slide, a plurality of grid knock-out pins on said stationary mold member projectable in the direction of separation of the mold members to eject a cast grid from the stationary mold member, a cam follower rockably supported on a fixed axis extending transversely of the direction of movement of said slide, said cam follower being located in the path of travel of said cam and being operatively connected with said grid knock-out pins to actuate the pins when the slide is shifted a predetermined distance in the mold opening direction.

7. The combination set forth in claim 6 including a shaft extending transversely of the path of travel of the slide for pivotal movement about said fixed axis, a first arm fixed to said shaft and supporting said cam follower, a second arm fixed to said shaft and adapted to oscillate upon interengagement of said cam and cam follower and linkage means operatively connecting the distal end of the second arm with said grid knock-out pins.

8. The combination set forth in claim 7 wherein said linkage means includes a slide assembly slideably mounted for movement in the direction of separation of said movable mold member, said slide assembly being adapted to engage said grid knock-out pins to actuate the same and a link pivotally connecting the distal end of said second arm and said slide assembly.

9. The combination set forth in claim 7 including a lever pivotally supported at one end on the distal end of said first arm, said cam follower being mounted on the other end of said lever, means limiting pivotal movement of said lever in one direction to a predetermined position relative to said first arm such that, when the cam urges said lever to pivot beyond said predetermined position, said arm rocks about the axis of said shaft, said lever being free to pivot in the opposite direction relative to said first arm.

10. The combination set forth in claim 9 wherein said cam is shaped to urge said lever beyond said predetermined position when it encounters the cam follower as the slide moves from the retracted to the extended position.

11. The combination set forth in claim 10 including means biasing said knock-out pins to the retracted position so that when the cam urges said lever to pivot in said opposite direction said biasing means at least partially retract said pins.

12. The combination set forth in claim 11 wherein said cam follower is spaced from said cam when the slide is in the retracted position a distance corresponding to not more than three-quarters of the stroke of the slide.

13. The combination set forth in claim 11 wherein said cam follower is spaced from said cam when the slide is in the retracted position a distance corresponding to one-half to two-thirds of the stroke of the slide.

14. The combination set forth in claim 11 wherein said cam is shaped to first urge said lever in a direction beyond said predetermined position whereby to project said pins when the cam initially encounters the cam follower and to thereafter urge the machine in the opposite direction as the cam travels past the cam follower whereby to cause said biasing means to at least partially retract said pins.

15. The combination set forth in claim 6 wherein said cam follower is spaced from said cam when the slide is in the retracted position a distance corresponding to between one-half and three-quarters of the stroke of the slide.

16. The combination set forth in claim 6 wherein said cam follower is spaced from the cam when the slide is in the retracted position a distance corresponding to between one-half and two-thirds of the stroke of the slide.

17. The combination set forth in claim 15 wherein said cam is shaped to cause said cam follower to rock first in one direction to project said pins and then in the opposite direction to at least partially retract said pins as the cam travels past the cam follower.

18. The combination set forth in claim 15 wherein said cam is shaped to produce a stroke of said pins which is only a fraction of the remaining stroke of the slide after the cam engages the cam follower.

19. The combination set forth in claim 15 wherein said cam is provided with a rise and a fall in the direction of travel of the slide.

20. The combination set forth in claim 19 wherein the extent of rise in the cam is such as to produce a stroke of said knock-out pins which is only a fraction of the remaining stroke of the slide after the cam engages the cam follower.

* * * * *